US006299073B1

(12) United States Patent
Strumolo et al.

(10) Patent No.: US 6,299,073 B1
(45) Date of Patent: Oct. 9, 2001

(54) PAINT SPRAY HOUSING FOR REDUCING PAINT BUILDUP

(75) Inventors: Gary S. Strumolo, Beverly Hills; Jacob Braslaw, Farmington Hills; Ronald H. Miller, Saline, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/497,597

(22) Filed: Feb. 3, 2000

(51) Int. Cl.[7] ..... B05B 5/025

(52) U.S. Cl. ..... 239/3; 239/690; 239/693; 239/695; 239/700; 239/703; 239/706; 427/421; 427/480

(58) Field of Search ..... 239/3, 690, 693, 239/695, 700, 701, 702, 703, 706, 707, 708; 118/326, 505; 427/721, 475, 480, 484, 485

(56) References Cited

U.S. PATENT DOCUMENTS 4,748,043 * 5/1988 Seaver et al. ..... 239/708
4,811,906 * 3/1989 Prus ..... 239/703
4,977,000 * 12/1990 Murayama et al. ..... 118/326
5,169,673 12/1992 Demeny et al. .
5,346,139 * 9/1994 Davis et al. ..... 239/703
5,527,564 6/1996 Napadow et al. .
5,738,727 4/1998 Cebola et al. .

* cited by examiner

*Primary Examiner*—David A. Scherbel
(74) *Attorney, Agent, or Firm*—Damian Porcari

(57) ABSTRACT

A paint spray system for directing paint to a part has a paint atomizer head having a bell housing and a bell-atomizer. An electrically conductive tape is applied to a surface of the paint atomizer. The tape may be applied to the bell housing or the front surface or side surfaces of the support housing. Tape is electrically connected to a power source to generate an electrical field and thereby an electrical force on charged paint particles produced at bell-atomizer. The electrical field repels the paint particles from the paint atomizer head to reduce the maintenance of the paint spray system.

24 Claims, 2 Drawing Sheets

PAINT SPRAY HOUSING FOR REDUCING PAINT BUILDUP

TECHNICAL FIELD

The present invention relates generally to electrostatic spray coating, and more specifically, to an improved spray head for spray coating.

BACKGROUND

Various products including automotive vehicle are typically painted using an electrostatic spray process. An electrostatic spray process uses a conductor that applies a potential difference between paint spray particles and the device to be painted. A modification of electrostatic spraying is a bell-atomizer spray process. For large products such as automotive vehicles, these systems are typically automated.

In the bell-atomizer process, electrostatic forces are combined with shaping air to direct paint toward the component to be painted. An application head has a bell cup that rotates at speeds in excess of about 30,000 rpms. The rotation of the bell cup acts to atomize the paint which is directed through the cup. Once atomized, the paint interacts with the shaping air through drag forces that divert the paint toward the target. An electric potential is applied to increase the axial momentum of the particles to increase the paint transfer efficiency.

One problem with known bell-atomizer automated spray processes is that due to side drafts, downdrafts, shaping air turbulence and interaction with the target, some air recirculates about the support housing and bell housing. As a result, paint may drip from the support housing and bell housing onto the component being painted. If this occurs, the component typically must be repainted and thus the cost of the component is increased.

To prevent drips from accumulating on the support housing and the bell housing, the automated process is typically stopped at frequent intervals so the support housing and bell housing can be cleaned. This also increases the cost of the product, particularly in assembly plants operating at full capacity. One known device for electrostatic spraying has a planar electrostatic shield surrounding the paint application head. The planar shield is spaced apart from the application head. Therefore, it is believed that the movement of the application head will result in air currents that cause paint to bypass the shield and buildup on the paint application head. Particularly, it is believed that paint will buildup on the sides of the application head resulting in the aforementioned drips. The buildup may be increased by spray from adjacent heads.

It would therefore be desirable to provide an improved paint application process that reduces the amount of maintenance as well as reduces the amount of repair costs for paint drip from the application head to the components to be painted.

SUMMARY OF THE INVENTION

It is therefore one object of the invention to improve bell-atomizer type electrostatic spray process that reduces the aforementioned problems by providing a bell atomizer having a bell housing extends from the front surface of the support housing and has a paint channel therethrough. The paint channel is fluidically coupled to the paint source. The bell-atomizer produces charged paint particles. An electrically conducted film is applied to the surface of the bell housing. The film is coupled to the power source and generates an electric field that in turn produces a force on the paint particles away from the bell housing.

In another aspect of the invention, conductive tape may be applied to the surfaces of a support housing to prevent paint buildup thereon.

In another aspect of the invention, a method of painting a part comprises the steps of: applying an electrically conductive tape to a bell housing of an atomizer head; generating charged paint particles through a bell atomizer; electrically coupling the tape to a power source; and, generating an electrical field and thereby an electrical force on said particles away from the bell housing.

One advantage of the invention is that the adhesive tape is easily replaced resulting in reduced clean up time and consequently in a less expensive paint process. Another advantage of the invention is that the paint transfer efficiency to the part has been increased. This is a particularly advantageous aspect with respect to a high volume mass production facility where incremental changes can result in significant cost savings.

Other objects and features of the present invention will become apparent when viewed in light of the detailed description of the preferred embodiment when taken in conjunction with the attached drawings and appended claims.

DETAILED DESCRIPTION OF THE PREFERRED EMBODIMENT

Figure 1:
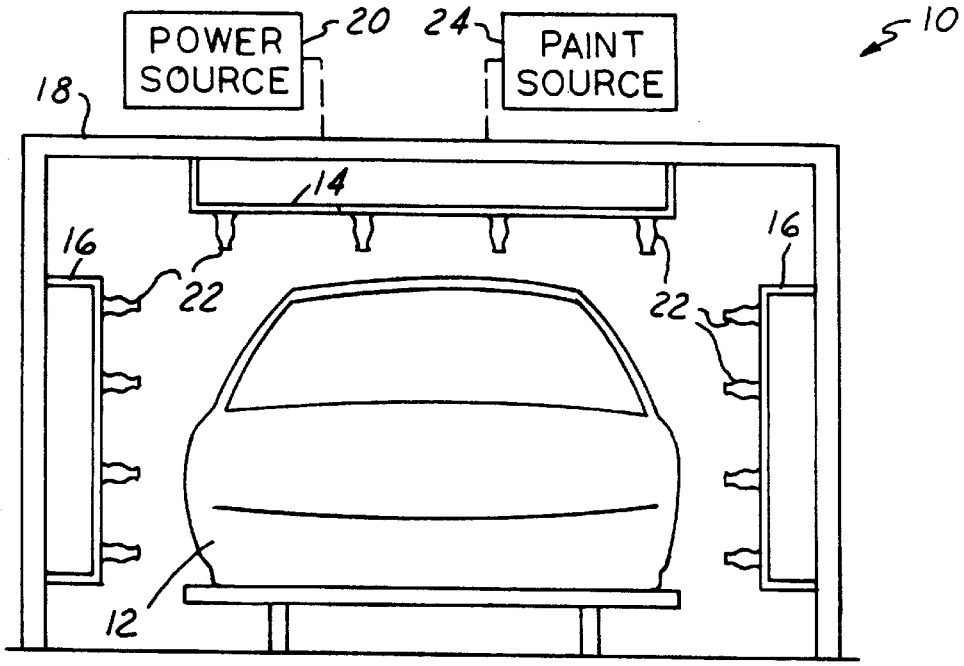
FIG. 1 is a perspective view of a paint spray system according to the present invention.

In the following figures, the same reference numerals will be used to identify identical components in the various views. The present invention is illustrated with respect to an automated spray application particularly suited for the automotive field. However, the present invention is applicable to various uses such as consumer appliances, industrial machinery, and other paint processes.

Referring now to FIG. 1, a paint spray System 10 for painting a part 12 is illustrated having a plurality of robotic arms that may include an overhead arm 14 and side arms 16. Each arm is coupled to rack 18. In such systems, arms 16 move according to XYZ coordinates with respect to rack 18. Commonly, the XYZ coordinates of arms 14, 16 vary depending upon the part 12 to be painted. It is common, for example, to maintain a predetermined distance from the surface to be painted. Each arm has a plurality of motors (not shown) that permit movement of the arms 14, 16 into desired positions with respect to part 12. A power source 20 is coupled to paint spray system 10 to power arms 14, 16. Each arm has a paint atomizer head 22 positioned thereon. As will be further described below, each paint atomizer head 22 generates a desired paint spray with respect to part 12. Each paint atomizer head 22 is fluidically coupled to a paint source 24 that supplies paint thereto.

Figure 2:
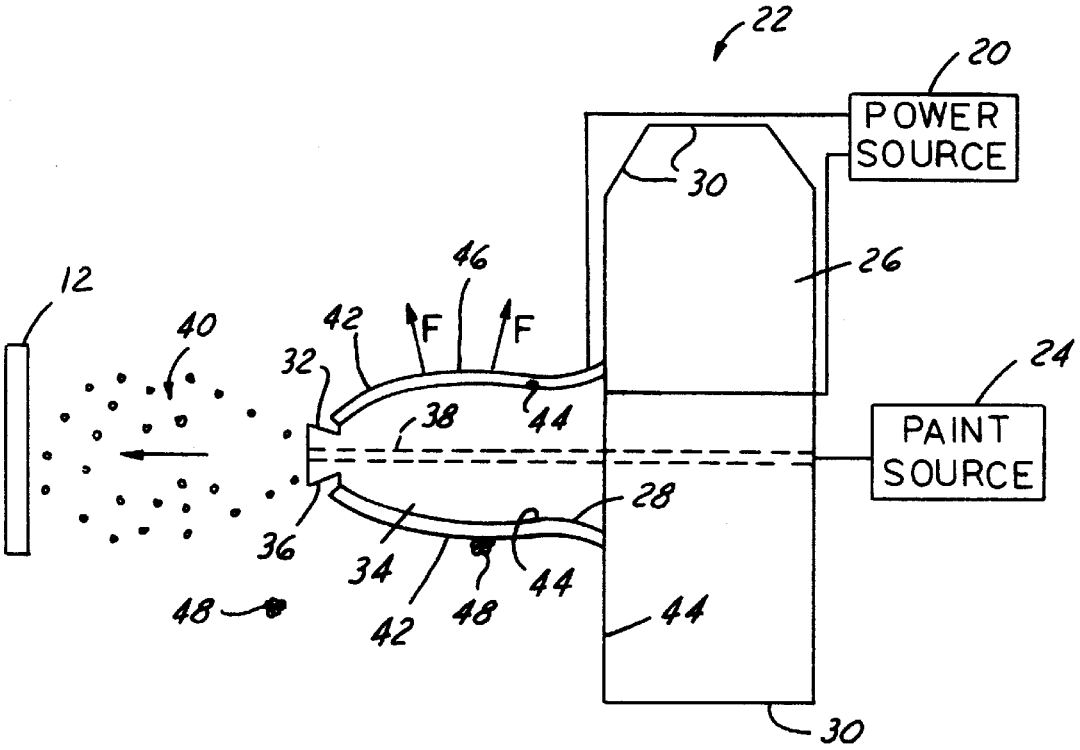
FIG. 2 is a cross-sectional view of a paint atomizer head formed according to the present invention.

Referring now to FIG. 2, an atomizer head 22 is illustrated in further detail. Atomizer head 22 has a support housing 26 with a front surface 28 that faces the parts to be painted. Support housing 26 also has a plurality of other surfaces such as side surfaces. As would be evident to those skilled in the art, various shapes of heads 22 may be used. For example, side arms 16 may use different heads than overhead heads. The teachings set forth herein are applicable to all types of heads.

Front surface 28 has a bell-atomizer 32 extending therefrom. Bell-atomizer has a bell housing 34 and a cup-shaped tip portion 36. Bell housing has in irregular curved shape resembling a bell. A paint channel 38 extends through bell-atomizer 32, support housing 26, and eventually couples to paint source 24. Bell-atomizers in their operation are well known in the art. Tip portion 36 receives paint from paint channel 38. Tip portion 36 rotates to generate stream lines of air current to direct paint particles 40 to part 12. In addition to the stream lines directing paint particles 40 to part 12, bell-atomizer 32 is coupled to power source 20 to impart a potential difference on paint particles 40 relative to part 12 so that they are directed electrically to part 12. Thus, a potential difference exists between particles 40 and part 12.

Paint-atomizer head 22 moves about on its associated robotic arms 14, 16. Therefore, various air drafts and movement occur which may allow particles to move toward front surface 28, side surfaces 30 and bell atomizer 32.

An electrically conductive film such as a double-sided electrically conductive mylar tape 42 is applied to bell housing 34. Advantageously, the flexible tape 42 conforms to the shape of the surfaces to which it is applied. This is particularly important since the shape of bell housing 34 may vary irregularly depending on their application. Tape 42 has a first side 44 positioned against bell housing 34 and a second side 46 positioned opposite first side 44 outward from bell housing 34. Preferably, both sides of tape 42 have adhesive thereupon. Tape 42 is coupled to power source 20 to provide an electrical potential on tape 42. Preferably, the entire surface of bell housing 34 is covered with tape 42. Thus, an electric field outward from tape 42 is developed along bell housing 34. The electric field therefore provides a force F on the paint particles that repel the paint particles away from bell housing 34. The electric potential difference between tape 42 and bell-atomizer 32 and target part 12 preferably ranges between 1 and 90 kilovolts depending on the application. In the present example, the electric field provided conforms to the outer surface of bell housing 34. That is, the electric field may not be uniform in any one direction due to the curvature of the bell housing 34. Therefore, the repelled paint particles may not necessarily be propelled toward part 12, although some may. During spraying, some particles 40 may combine to form relatively large particles 48. Relatively large particles 48 may be sized so that the electric field provided by tape 42 may not be sufficient to move the particles away from bell housing 34. Thus, the second side 46 with adhesive thereon retains large particles 48.

Figure 3:
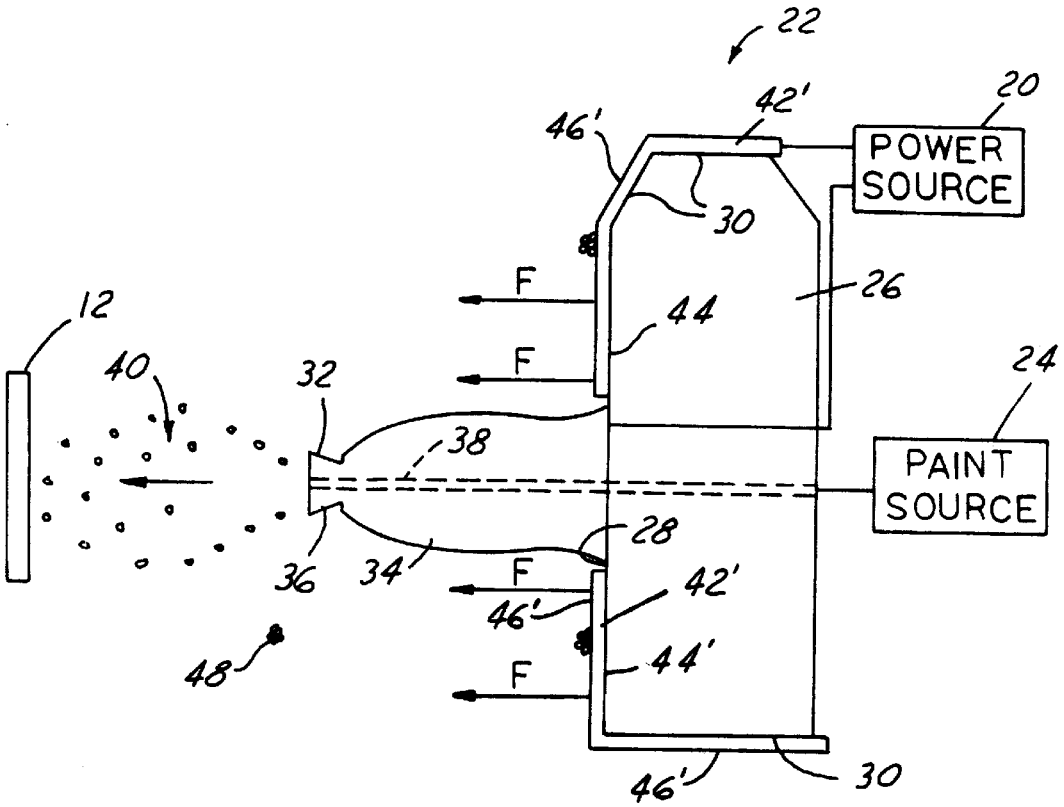
FIG. 3 is a cross-sectional view of an alternative embodiment of a paint atomizer head formed according to the present invention.

Referring now to FIG. 3, an alternative embodiment of the present invention is illustrated. In this embodiment, tape 42' is applied to front surface 28 and side surfaces 30 of support housing 26. This embodiment may be used alone or together with tape 42 on the bell housing 34 described above. Tape 42' conforms to the shape of the front surface 28 and side surfaces 30. This is particularly important since the shape of support housings may vary irregularly depending on their application. Tape 42' has a first side 44' positioned against support housing 26 and a second side 46' positioned opposite first side 44' outward from support housing 26. Preferably, both sides 44', 46' of tape 42' have adhesive thereupon. Tape 42' is coupled to power source 20 to provide an electrical potential on tape 42'. Preferably, the entire surface of support housing 26 facing part 12 is covered with tape 42'. The present invention is also applicable to side surfaces 30. Thus, an electric field outward from tape 42' is developed along support housing 26. The electric field therefore provides a force on the paint particles that repel the paint particles away from support housing 26. the electric potential difference between tape 42' and bell-atomizer 32 and target part 12 preferably ranges between 1 and 90 kilovolts depending on the application. In the present example, the electric field provided conforms to the outer surface of support housing 26. That is, the electric field may not be uniform in the direction of part 12. Therefore, the repelled paint particles may not necessarily be propelled toward part 12. As described above, during spraying, some particles 40 may combine to form relatively large particles 48. Relatively large particles 48 may be sized so that the electric field provided by tape 42' may not be sufficient to move the particles away from support housing 26. Thus, the second side 46' with adhesive thereon retains large particles 48.

In operation, the double-sided tape 42 and 42' are applied to bell housing and support housing prior to a paint operation as desired. The electrically conductive tape 42, 42' is coupled to power source 20 during operation. The robotic arms 14, 16 position paint atomizer head 22 in desirable locations and controls the application of paint therethrough from paint source 24. Particles 40 are charged by bell-atomizer 32. The electrical potential between paint particles 40 and stream lines formed by bell-atomizer 32 propel the particles 40 away from tape 42, 42'. Particles 40 that due to drafts or other stream lines approach front surface 28, side surfaces 30 or bell housing 34 having tape 42, 42' thereon, are also provided an electrostatic force to propel them in a direction away from support housing 26 and bell housing 34. Thus, a substantially reduced amount of paint particles are attached to support housing 26 and bell housing 34 during operation of the paint process. Thus, a reduced amount of maintenance and reduced number of drips from support housing 26 during the painting process are produced.

To perform maintenance on support housing 26, tape 42, 42' preferably has an adhesive that allows easy removal from support housing 26. The tape 42, 42' is removed from support housing 26 to expose an area or surface thereon. Tape 42 is discarded and a second piece of tape 42 is applied to surfaces 28, 30. This method was found to substantially reduce the time of maintenance for each atomizer head 22.

While particular embodiments of the invention have been shown and described, numerous variations and alternate embodiments will occur to those skilled in the art. Accordingly, it is intended that the invention be limited only in terms of the appended claims.

What is claimed is:

1. A paint atomizer head coupling to a power source and a paint source comprising:

a support housing having a front surface and side surfaces;

a bell atomizer extending from the front surface having a bell housing with a paint channel therethrough fluidically coupled to said paint source, said bell atomizer producing charged paint particles; and an electrically conductive film applied to the bell housing, said film coupled to said power source to generate an electrical field that provides a force on the paint particles away from the bell housing.

2. A paint atomizer head as recited in claim 1 wherein said film comprises an electrically conductive tape.

3. A paint atomizer head as recited in claim 1 wherein said tape has adhesive applied to a first side and to a second side of said tape.

4. A paint atomizer head as recited in claim 1 wherein said electrically conductive film is applied to said front surface.

5. A paint atomizer head as recited in claim 1 wherein said electrically conductive film is applied to said side surface.

6. A paint atomizer head as recited in claim 1 wherein said electrical field is not uniformly parallel.

7. A paint atomizer head coupling to a power source and a paint source comprising:

a support housing having a front surface and side surfaces;

a bell atomizer extending from the front surface having a paint channel therethrough fluidically coupled to said paint source, said bell atomizer producing charged paint particles; and an electrically conductive film applied to the front surface, said film coupled to said power source to generate an electrical field that provides a force on the paint particles away from the support housing.

8. A paint atomizer head as recited in claim 7 wherein said film comprises an electrically conductive tape.

9. A paint atomizer head as recited in claim 7 wherein said tape has adhesive applied to a first side and to a second side of said tape.

10. A paint atomizer head as recited in claim 7 wherein said electrically conductive film is applied to said side surface.

11. A paint spray system having a power source and a paint supply comprising:

a rack;

a robotic arm movably coupled to said rack;

a paint atomizer head coupled to said robotic arm, said atomizer head comprising a bell atomizer extending from a front surface having a bell housing with a paint channel extending therethrough fluidically coupled to said paint source, said bell atomizer producing charged paint particles; and an electrically conductive film applied to the bell housing, said film coupled to said power source to generate an electrical field that provides a force on the paint particles away from the bell housing.

12. A paint spray system as recited in claim 11 wherein said rack comprises a plurality of robotic arms, each of said plurality of robotic arms comprising an atomizer head.

13. A paint spray system as recited in claim 11 wherein said tape has adhesive applied to a first side and to a second side.

14. A paint spray system as recited in claim 11 wherein said electrically conductive film is applied to said front surface.

15. A paint spray system as recited in claim 11 wherein said electrically conductive film is applied to side surfaces.

16. A paint spray system as recited in claim 11 wherein said electrical field is not uniformly parallel.

17. A method of painting a part comprising the steps of;

applying an electrically conductive tape to an atomizer head;

generating charged paint particles through a bell atomizer extending from a bell housing;

electrically coupling the tape to a power source; and generating an electrical field and thereby an electrical force on the particles away from the bell housing.

18. A method as recited in claim 17 wherein said step of applying tape comprises applying a double-sided adhesive tape.

19. A method as recited in claim 18 further comprising the step of combining paint particles to form relatively large particles, and coupling the relatively large particles to an exposed surface of said double-sided adhesive tape.

20. A method as recited in claim 17 wherein the step of applying comprises applying the electrically conductive tape to a front surface of a support housing.

21. A method as recited in claim 17 wherein the step of applying comprises applying the electrically conductive tape to a side surface of a support housing.

22. A method as recited in claim 17 wherein the step of applying comprises applying the electrically conductive tape to said bell housing of the bell atomizer.

23. A method as recited in claim 17 further comprising the steps of removing the electrically conductive tape to form an exposed area.

24. A method as recited in claim 23 applying a second piece of electrically conductive tape to said bell housing at the exposed area.

* * * * *